United States Patent [19]

Friedenthal et al.

[11] Patent Number: 5,035,375

[45] Date of Patent: Jul. 30, 1991

[54] FIBER OPTIC RADAR GUIDED MISSILE SYSTEM

[75] Inventors: Kenneth J. Friedenthal, Los Angeles, Calif.; Michael de La Chapelle, Bellevue, Wash.; Hui-Pin Hsu, Northridge, Calif.

[73] Assignee: Hughes Aircraft Company, Los Angeles, Calif.

[21] Appl. No.: 286,436

[22] Filed: Dec. 19, 1988

[51] Int. Cl.[5] ..... F41G 7/32

[52] U.S. Cl. ..... 244/3.12; 342/53; 342/58; 342/62

[58] Field of Search ..... 342/52, 53, 55, 58, 342/62; 244/3.12

[56] References Cited

U.S. PATENT DOCUMENTS

| | | | |
|---|---|---|---|
| 3,001,186 | 9/1961 | Baltzer | 342/58 |
| 3,041,011 | 6/1962 | Dhanes | 342/62 X |
| 3,182,930 | 5/1965 | Randolph, Jr. et al. | 342/3.13 |
| 3,729,150 | 4/1973 | Conger | 342/3.13 |
| 3,743,215 | 7/1973 | Harris | 244/3.14 |
| 3,891,161 | 6/1975 | Hermann | 244/3.12 |
| 3,938,148 | 2/1976 | Hobson | 342/199 |
| 3,943,357 | 3/1976 | Culver | 250/199 |
| 4,185,796 | 1/1980 | Riley | 244/3.12 |
| 4,611,771 | 9/1986 | Gibbons et al. | 244/3.12 |
| 4,653,032 | 3/1987 | Schwarz et al. | 367/113 |
| 4,705,237 | 11/1987 | Goldfeld et al. | 244/3.12 |
| 4,770,370 | 9/1988 | Pinson | 244/3.12 |
| 4,796,833 | 1/1989 | Pinson | 244/3.12 |
| 4,860,968 | 8/1989 | Pinson | 244/3.12 |
| 4,907,763 | 3/1990 | Pinson | 244/3.12 |
| 4,967,980 | 11/1990 | Pinson | 244/3.12 |
| 4,974,793 | 12/1990 | Pinson | 244/3.12 |

OTHER PUBLICATIONS

Electro 81 Conference Record, vol. 6, part 8c/3, 7-9 Apr. 1981, New York, NY, US, H. Wichansky et al., "Fiber Optic Implications for Missile Guidance Design", pp. 1-10, see whole document.

Revue Internationale De Defense, vol. 17, No. 2, 1984, Cointrin-Geneve CH, pp. 151-154, J. Rhea, "Utilisations Militaires des Fibres Optiques", see the whole document.

Milocom 86, 1986, IEEE Military Communications Conference, 5-9 Oct. 1986, Monteray, CA, Communications-Computers, Teamed for the '90s, Conference Record, vol. 2 of 3, IEEE, US-D. Biswas et al., "Fiber-optic Guidance for Missiles", pp. 3331-3335, see whole document.

*Primary Examiner*—John B. Sotomayor

*Attorney, Agent, or Firm*—R. M. Heald; C. D. Brown; W. K. Denson-Low

[57] ABSTRACT

A fiber optic radar guided missile system 10 is disclosed which includes a radar receiver 12 disposed in a missile for receiving radar reflections and providing a first optical signal in response thereto. An optical receiver 14 is disposed at a launcher for receiving the first optical signal and for providing a set of electrical signals in response thereto. A fiber optic link 32 is connected between the missile and the launcher for communicating the first optical signal from the radar receiver 12 to the optical receiver 14.

In a specific embodiment, the invention 10 includes a first system 12 disposed in a missile for receiving radar reflections which includes only an antenna 16 for receiving radar reflections, a radar seeker 18 for providing a first electrical in response to the received radar reflections, and a first fiber optic transmitter 26 for converting the first electrical signal into a first optical signal. An optical receiver 14 is located at a launcher for receiving the first optical signal and for providing a set of electrical signals in response thereto. The optical receiver 14 at the launcher includes a first fiber optic receiver 48 for converting the first optical signal into a second electrical signal and a signal processor 56 for processing the second electrical signal and providing radar output data. A fiber optic link 32 is provided for communicating the first optical signal from the radar receiver 12 to the optical receiver 114 at the launcher and missile commands from the launcher to the missile.

7 Claims, 1 Drawing Sheet

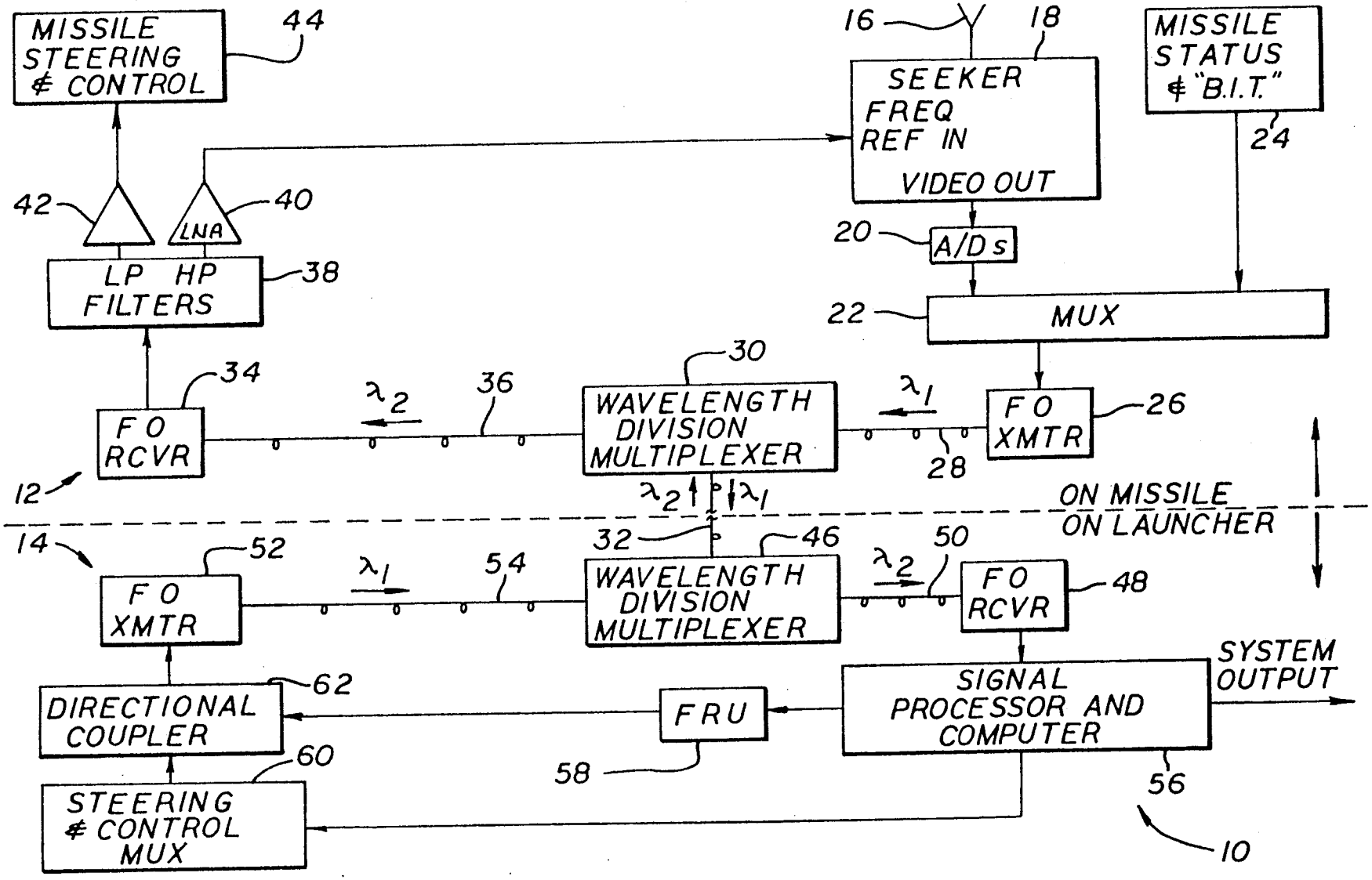
MISSILE STATUS & "B.I.T."
24
SEEKER
FREQ REF IN
VIDEO OUT
18
16
A/Ds
20
MUX
22
FO XMTR
26
28
λ1
ON MISSILE
ON LAUNCHER
FO RCVR
48
50
λ2
SIGNAL PROCESSOR AND COMPUTER
56
SYSTEM OUTPUT
10
WAVELENGTH DIVISION MULTIPLEXER
30
λ1
λ2
46
32
WAVELENGTH DIVISION MULTIPLEXER
FRU
58
36
54
λ2
λ1
MISSILE STEERING & CONTROL
44
LNA
40
42
LP HP FILTERS
38
34
FO RCVR
52
FO XMTR
62
DIRECTIONAL COUPLER
60
STEERING & CONTROL MUX
12
14

FIBER OPTIC RADAR GUIDED MISSILE SYSTEM

BACKGROUND OF THE INVENTION

1. Field of the Invention

The present invention relates to remotely piloted vehicles. More specifically, the present invention relates to fiber optic guided remotely piloted vehicles.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Television (TV) and infrared (IR) fiber optic guided missiles are well known in the art. TV guided missiles utilize a close circuit camera, mounted in the missile, to send encoded video signals to an image processor or a television display, mounted typically at or in a launch vehicle. IR guided missiles utilize an infrared detector to send infrared signals to an IR image processor or a display at a base or launch station. In either technology, the fiber optic link has been found to afford a significant system performance improvement via the provision of a secure, low noise data channel between the missile and a launcher.

However, it is well known in the art that the capability of TV and IR guided missiles may be severely limited under some adverse weather conditions. For example, smoke, haze and darkness can limit the visibility and hence performance of TV guided missiles. Thus, there is a general need in the art for a guided missile technology and system that incorporates the advantages of high resolution adverse weather guidance together with the fiber optic communications link.

One such well known technology is radar. Unfortunately, the cost associated with the implementation of high resolution radar technology in a fiber optic guided missile has heretofore been viewed as too high to make this approach feasible. There is therefore an unresolved need in the art for an inexpensive fiber optic radar guided missile.

SUMMARY

The need in the art is addressed by the fiber optic radar guided missile system of the present invention which includes a radar receiver disposed in a missile for receiving radar reflections and providing a first optical signal in response thereto. An optical receiver is disposed at a launcher for receiving the first optical signal and for providing a set of electrical signals in response thereto. A second optical transmitter is disposed at a launcher for converting a frequency reference and missile command data into a second optical signal for fiber transmission. A fiber optic link is connected between the missile and the launcher for communicating the first optical signal from the radar receiver to the optical receiver.

In a specific embodiment, the invention includes a first system disposed in a missile for receiving radar reflections which includes only an antenna for receiving radar reflections, a radar seeker for providing a first electrical signal in response to the received radar reflections, and a first fiber optic transmitter for converting the first electrical signal into a first optical signal. An optical receiver is located at a launcher for receiving the first optical signal and for providing a set of electrical signals in response thereto. The optical receiver at the launcher includes a first fiber optic receiver for converting the first optical signal into a second electrical signal and a signal processor for processing the second electrical signal and providing radar output data. A fiber optic link is provided for communicating said first optical signal from the radar receiver to the optical receiver at the launcher and the second optical signal in the opposite direction. In a more specific embodiment, a second system is disposed in the launcher for generating frequency reference and missile command data and a second fiber optic transmitter for converting the frequency reference and command data into a second optical signal. A second optical receiver is located at the missile for converting the second optical signal into frequency reference and command data.

The invention allows for an advantageous partitioning of the system components to minimize the cost associated with the throwaway portion thereof. Specifically, the invention allows a signal processor and frequency reference unit to be located in the launcher to reduce missile costs and to increase system capability.

BRIEF DESCRIPTION OF THE DRAWINGS

The Figure is a block diagram of an illustrative embodiment of the fiber optic radar guided missile system of the present invention.

DESCRIPTION OF THE INVENTION

The Figure shows a block diagram of an illustrative embodiment of the fiber optic radar guided missile system 10 of the present invention. The system 10 includes a missile subsystem 12 and a launcher subsystem 14. The missile subsystem 12 includes a radar antenna 16 connected to a conventional radar seeker 18. As is well known in the art, the radar seeker 18 receives a frequency reference signal and transmits a radar signal through the antenna 16. The transmitted signal is reflected off objects, surfaces and the like and is detected by the antenna 16 as a radar return. In the illustrative embodiment, the radar seeker 18 downconverts these returns to a video (or baseband) signal. Those skilled in the art will recognize that the invention is not limited to the downconversion of the radar signal to baseband prior to transmission to the launcher subsystem 14. The radar signal may be transmitted to the launcher 14 as received without departing from the scope of the present teachings.

The received signal is digitized by an analog-to-digital (A/D) converter 20 which provides a first input to a multiplexer 22. A second input to the multiplexer 22 may be provided by conventional missile status and built-in-test subsystems 24. As is known in the art, the missile status and built-in-test subsystems 24 provide missile velocity and mode information from onboard sensors (not shown). Thus, the multiplexer 22 provides digitized radar returns with missile status information to a conventional first fiber optic transmitter 26. The fiber optic transmitter 26 converts the electrical input from the multiplexer 22 to an optical signal of a first lo wavelength $\lambda_1$ on a first fiber optic line 28. Those skilled in the art may purchase a fiber optic transmitter from a number of vendors. The specifications of the fiber optic transmitter 26 are not demanding with respect to the present invention as a low speed transmitter will suffice subject to the modulation bandwidth and laser linewidth requirements of a particular application for which one of ordinary skill in the art can make an appropriate design choice. For the present invention, the first fiber optic transmitter 26 should have enough output power to overcome optical losses in the fiber. It should have enough modulation bandwidth to convert the received electrical signal to an optical signal.

Unless otherwise specified herein, the optical fibers utilized in the invention may be commercially available high strength optical fibers.

The output of the fiber optic transmitter 26 provides a first input to a conventional wavelength division multiplexer 30 (WDM). Wavelength division multiplexers are known in the art. As discussed more fully below, the wavelength division multiplexer 30 downlinks the optical radar return and missile status data, of wavelength $\lambda_1$, from the fiber optic transmitter 26 to the launcher subsystem 14 via a substantial length of a second optic fiber 32. The wavelength division multiplexer 30 simultaneously provides an uplink for a optical signal of wavelength $\lambda_2$ from the launcher subsystem 14 from the fiber 32 and directs it to a first fiber optic receiver 34 via a third optical fiber 36. The second optic fiber 32 is mounted on a spool (not shown) and pays out from the missile (not shown) in flight. If the launcher is on a moving vehicle, the second optic fiber 32 would also payout from a spool in the vehicle.

As is well known in the art, the fiber optic receiver 34 includes a photodetector and converts a received optical signal into an electrical signal. The fiber optic receiver 34 should be a high speed wideband optical receiver having a photodiode with enough bandwidth to respond to or detect the incoming signal described more fully below. The uplink signal includes a frequency reference signal for radar transmission and missile steering and control data. Thus, the output of the first fiber optic receiver 34 is separated by filters 38 to extract these two signal components. That is, the frequency reference signal is extracted by a high pass filter in the filter 38 and amplified by a low noise amplifier 40 before being input to and transmitted by the seeker 18. The missile steering and control signals are extracted by a low pass filter in the filter 38 and amplified by an amplifier 42 before being input to a conventional missile steering and control subsystem 44.

The uplink to the missile subsystem 12 and the downlink to the launcher subsystem 14 is provided by the first wavelength division multiplexer 30, the second optical fiber 32 and a second conventional wavelength division multiplexer 46 included within the launcher subsystem 14 mounted at a base station or on a launch vehicle. The second WDM 46 downlinks the optical radar return and missile status data, of wavelength $\lambda_1$, from the second optic fiber 32 to a second fiber optic receiver 48 via a fourth optic fiber 50. The second WDM 46 simultaneously provides an uplink for a optical signal of wavelength $\lambda_2$ from a second fiber optic transmitter 52 via a fifth optic fiber 54 and directs it to a the missile subsystem 12 via the second optic fiber 32. The first and second WDMs should be designed to provide adequate optical isolation between the first and second signals of wavelength $\lambda_1$ and $\lambda_2$ to minimize crosstalk.

In addition to the WDM 46, the second fiber optic receiver 48 and the second fiber optic transmitter 52, launcher subsystem 14 further includes a signal processor and computer 56, a frequency reference unit 58, a directional coupler 60 and a steering and control multiplexer 62. The second fiber optic receiver 48 includes a photodetector (not shown) and converts the received optical signal, containing digitized radar returns and missile status information, into an electrical signal. The second fiber optic receiver 48 may be a commercially available low speed optical receiver.

The output of the second fiber optic receiver 48 is input to a signal processor and control computer 56. The signal processor and control computer 56 processes the digitized radar return signals, utilizing fast fourier transforms (FFTs) and other radar processing functions as is known in the art, and generates low data rate steering and control commands to be transmitted back to the missile. The signal processor and control computer 56 provides steering signals to the multiplexer 60 and amplitude, angle and range information as a system output and is displayed or otherwise processed as desired. This allows a human operator to control the flight of the missile and direct it to a target. The frequency reference unit 58 is essentially a reference oscillator or perhaps a controllable reference oscillator as known by those versed in the art. It provides the high frequency reference signal required by the radar seeker 18 to transmit a coherent radar signal. A steering and control multiplexer 60 mixes steering and control signals from a steering and control subsystem (not shown) with steering and control adjustment signals from the signal processor and control computer 56. The outputs of the FRU 58 and the steering and control multiplexer 60 are combined by a conventional directional coupler 62 and input to the second fiber optic transmitter 52.

The second fiber optic transmitter 52 converts the combined reference and steering and control signals to optical signals. The output of the second fiber optic transmitter 52 is the uplink signal of wavelength $\lambda_2$ and is provided to the missile subsystem 12 via the fifth optical fiber 54 and the second WDM 46. In the preferred embodiment, the second fiber optic transmitter 52 is a wideband transmitter. The second fiber optic transmitter 52 must have enough power to overcome optical loss through the fifth, second and third optical fibers 54, 32 and 36 and any losses in demodulation. The second fiber optic transmitter 52 should have a sufficiently fast response time or modulation bandwidth to modulate the input signal up to the desired transmission band.

Thus, the present invention has been described herein with reference to a particular embodiment for a particular application. Those skilled in the art having access to the present teachings will recognize additional modifications, applications and embodiments within the scope thereof. For example, it is not necessary to downconvert the radar signal received by the missile down to baseband. Nor is it necessary to convert to a digital signal before fiber optic transmission. The received radar signal may be communicated to the launcher without downconversion and without departing from the scope of the invention. Further, the optic fibers may be replaced by other optical couplers or a direct optical path without departing from the scope of the invention.

Accordingly,

What is claimed is:

1. A fiber optic radar guided missile system comprising:

a missile;

a base; and, fiber optic link means for communicating a first optical signal through an optical fiber extending between said missile and said base while simultaneously communicating a second optical signal through said optical fiber between said base and said missile;

said missile including:

a radar transmitter for transmitting radar signals to a target to provide reflected radar signals, means for receiving reflected radar signals to provide said first optical signal, and transmitter means for transmitting said first optical signal over said fiber optic link means to said base:

said base including:

base receptor means for receiving said first optical signal to provide a first electrical signal, and base processor means for processing said first electrical signal to provide frequency reference information;

a frequency reference unit for receiving said frequency reference information to provide a frequency reference signal;

multiplexer means for providing steering and control adjustment signals and coupler means for combining said frequency reference signal and said steering and control adjustment signals into a combined reference and steering and control signal;

a fiber optic transmitter means for receiving said combined reference and steering and control signal and generating a second optical signal for communication over said fiber optic link means to said missile;

said missile further including:

missile receptor means for receiving said second optical signal to provide a second electrical signal, missile processor means for processing said second electrical to recover said frequency reference signal, and means for coupling said recovered frequency reference signal to said radar transmitter.

2. The radar guided missile system of claim 1, wherein said missile further includes a radar antenna for receiving said reflected radar signals.

3. The radar guided missile system of claim 1, wherein said missile further includes a seeker to provide said first optical signal.

4. The radar guided missile system of claim 1, wherein said fiber optic link means comprising first optical multiplexer means disposed in said missile for directing said first optical signal along a first wavelength through said optical fiber while simultaneously directing said second optical signal to said missile receptor means.

5. The radar guided missile system of claim 4, wherein said fiber optic link means further comprising second optical multiplexer means disposed at said base for directing said first optical signal from said optical fiber to said base receptor means while simultaneously directing said second optical signal along a second wavelength through said optical fiber.

6. The radar guided missile system of claim 1, wherein said missile includes a plurality of functional subsystems and said base processor means process said first electrical signal and provides a set of electrical signals for use by at least two of said functional subsystems.

7. A fiber optic guided missile system comprising:

a missile;

fiber optic link means for transmitting a first optical signal through said optical fiber between said missile and said base and transmitting a second optical signal through said optical fiber between said base and said missile;

said missile including a radar transmitter for transmitting radar signals to a target to provide reflected radar signals and means for converting said reflected radar signals into said first optical signal, for transmission to said base;

said base including base receptor means for converting said first optical signal into a first electrical signal, and base processor means for processing said first electrical signal to provide frequency reference information;

a frequency reference unit for receiving said frequency reference information to provide a frequency reference unit;

said base also including multiplexer means for providing steering and control adjustment signals and coupler means for combining said frequency reference signal and said steering and control adjustment signals into a combined reference and steering and control signal;

fiber optic transmitter means for converting said combined reference and control and adjustment signal into said second optical signal for transmission to said missile;

said missile further including missile receptor means for receiving said second optical signal to provide a second electrical signal and missile processor means for processing said second electrical signal to recover said frequency reference signal and means for coupling said recovered frequency reference signal to said radar transmitter.

* * * * *